US012302961B2

(12) United States Patent
Harmon

(10) Patent No.: US 12,302,961 B2
(45) Date of Patent: May 20, 2025

(54) BOWLING WRIST BRACE DEVICE

(71) Applicant: James Harmon, Cleveland Heights, OH (US)

(72) Inventor: James Harmon, Cleveland Heights, OH (US)

( * ) Notice: Subject to any disclaimer, the term of this patent is extended or adjusted under 35 U.S.C. 154(b) by 0 days.

(21) Appl. No.: 18/381,268

(22) Filed: Oct. 18, 2023

(65) Prior Publication Data

US 2025/0127248 A1 Apr. 24, 2025

(51) Int. Cl.
*A41D 13/08* (2006.01)

(52) U.S. Cl.
CPC ..... *A41D 13/088* (2013.01)

(58) Field of Classification Search
CPC .. A41D 13/088; A41D 19/0024; A63B 71/14; A61F 5/00; A61F 13/00; A61F 5/0118
USPC ..... 2/16
See application file for complete search history.

(56) References Cited

U.S. PATENT DOCUMENTS 2,924,458 A * 2/1960 Barry ..... A41D 13/088 2/161.1
4,048,674 A * 9/1977 Chesnick ..... F41B 5/14 2/16
4,479,648 A 10/1984 Alivo, Jr.
4,928,678 A * 5/1990 Grim ..... A61F 13/04 602/8
4,941,460 A * 7/1990 Working ..... A61F 5/05866 473/213
5,708,981 A 1/1998 Tilton
6,773,410 B2 * 8/2004 Varn ..... A61F 5/0118 602/5
7,704,219 B2 * 4/2010 Nordt, III ..... A61F 5/0118 602/5
2015/0282539 A1 10/2015 Darby

FOREIGN PATENT DOCUMENTS

KR 102111087 5/2020

* cited by examiner

*Primary Examiner* — Timothy K Trieu

(57) ABSTRACT

A bowling wrist brace device includes a brace which extends along a substantial length of a bowler's forearm when the brace is worn on the bowler's forearm. The brace has a forearm attachment, a wrist attachment and a hand attachment and the brace is comprised of a rigid material to inhibit flexion in the bowler's wrist when the bowler releases a bowling ball. A cushion is bonded to the brace to enhance comfort for the bowler. A plurality of belts is each attached to the brace and each of the belts can be wrapped around a respective one of the bowler's forearm, the bowler's wrist and the bowler's hand. Each of the plurality of belts is releasably matable to a respective one of the forearm attachment, the wrist attachment and the hand attachment to secure the brace to the bowler's forearm.

16 Claims, 7 Drawing Sheets

BOWLING WRIST BRACE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wrist brace devices and more particularly pertains to a new wrist brace device for retaining a bowler's wrist at a preferred orientation for releasing a bowling ball. The device includes a brace that has a forearm attachment and a wrist attachment and a hand attachment. The device includes a plurality of belts each attached to the brace which can be wrapped around a bowler's forearm and wrist and hand and subsequently attached to a respective forearm attachment or wrist attachment or hand attachment.

(2) Description of Related Art Including Information Disclosed Under 37 CFR 1.97 and 1.98

The prior art relates to wrist brace devices including a variety of bowling braces devices which each includes a series of straps that can be wrapped around a bowler's wrist and hand and a support member for inhibiting flexion of the bowler's wrist when releasing a bowling ball. In no instance does the prior art disclose a bowling brace that includes a rigid brace which extends along a dorsal side of a bowler's forearm and wrist and hand and belts for securing the brace to the bowler's forearm, wrist and hand.

BRIEF SUMMARY OF THE INVENTION

An embodiment of the disclosure meets the needs presented above by generally comprising a brace which extends along a substantial length of a bowler's forearm when the brace is worn on the bowler's forearm. The brace has a forearm attachment, a wrist attachment and a hand attachment and the brace is comprised of a rigid material to inhibit flexion in the bowler's wrist when the bowler releases a bowling ball. A cushion is bonded to the brace to enhance comfort for the bowler. A plurality of belts is each attached to the brace and each of the belts can be wrapped around a respective one of the bowler's forearm, the bowler's wrist and the bowler's hand. Each of the plurality of belts is releasably matable to a respective one of the forearm attachment, the wrist attachment and the hand attachment to secure the brace to the bowler's forearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
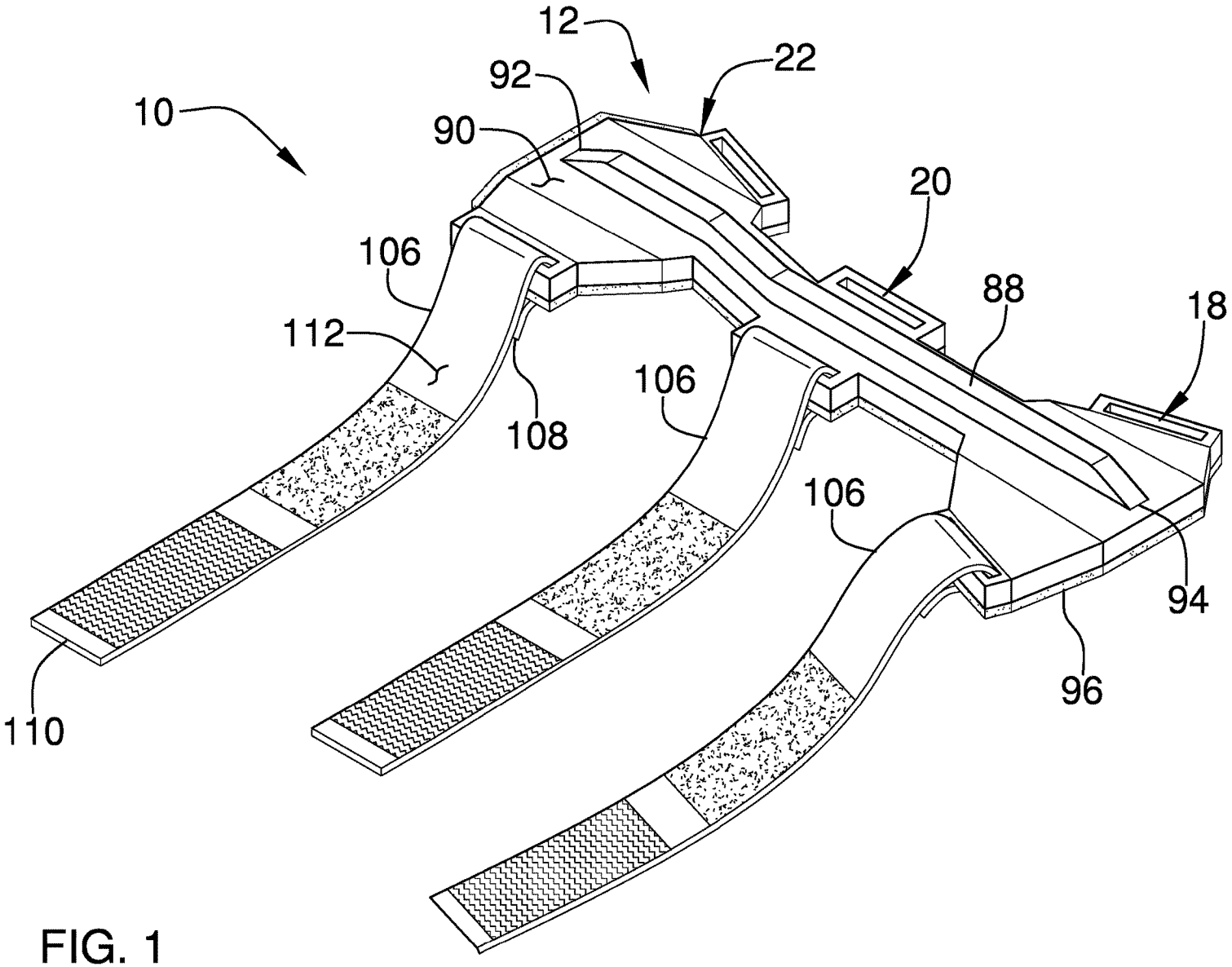
FIG. 1 is a top perspective view of a bowling wrist brace device according to an embodiment of the disclosure.
Figure 2:
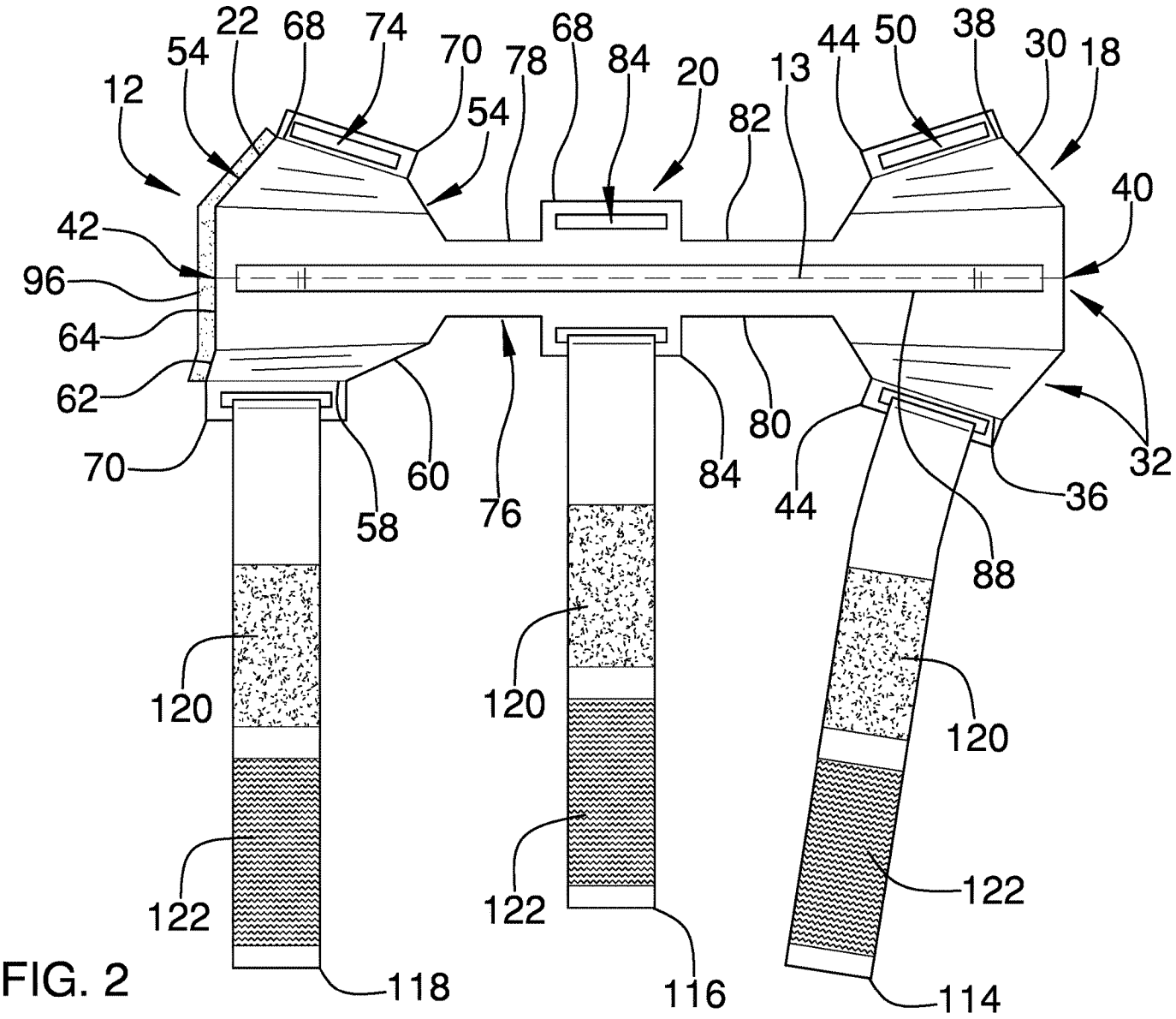
FIG. 2 is a top view of an embodiment of the disclosure.
Figure 3:
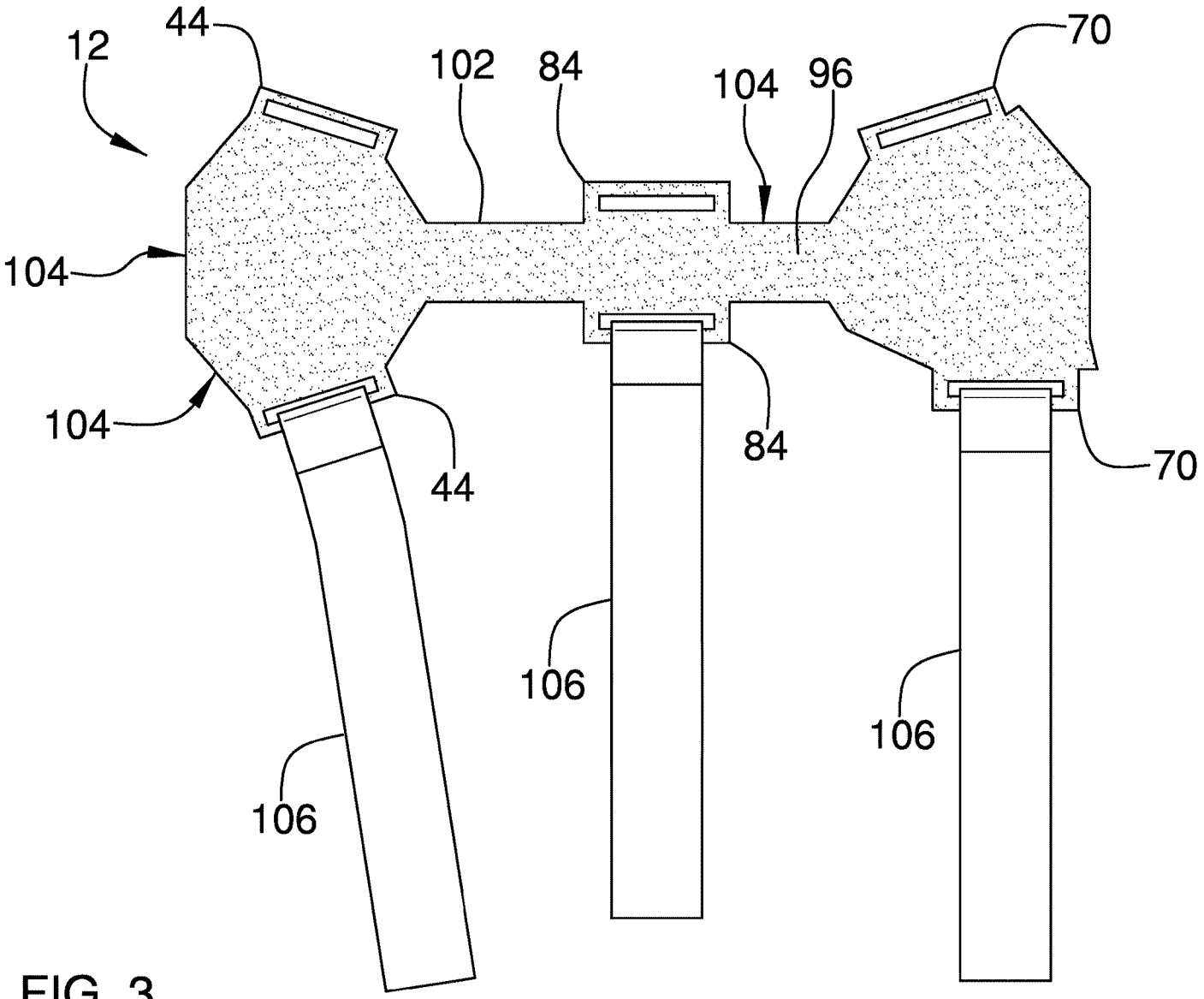
FIG. 3 is a bottom view of an embodiment of the disclosure.
Figure 4:
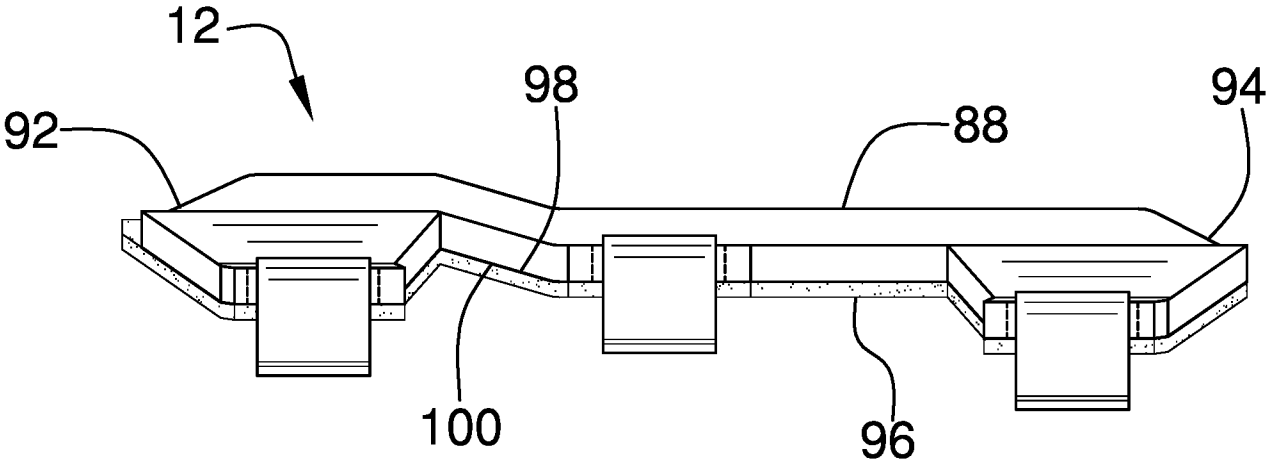
FIG. 4 is a left side view of an embodiment of the disclosure.
Figure 5:
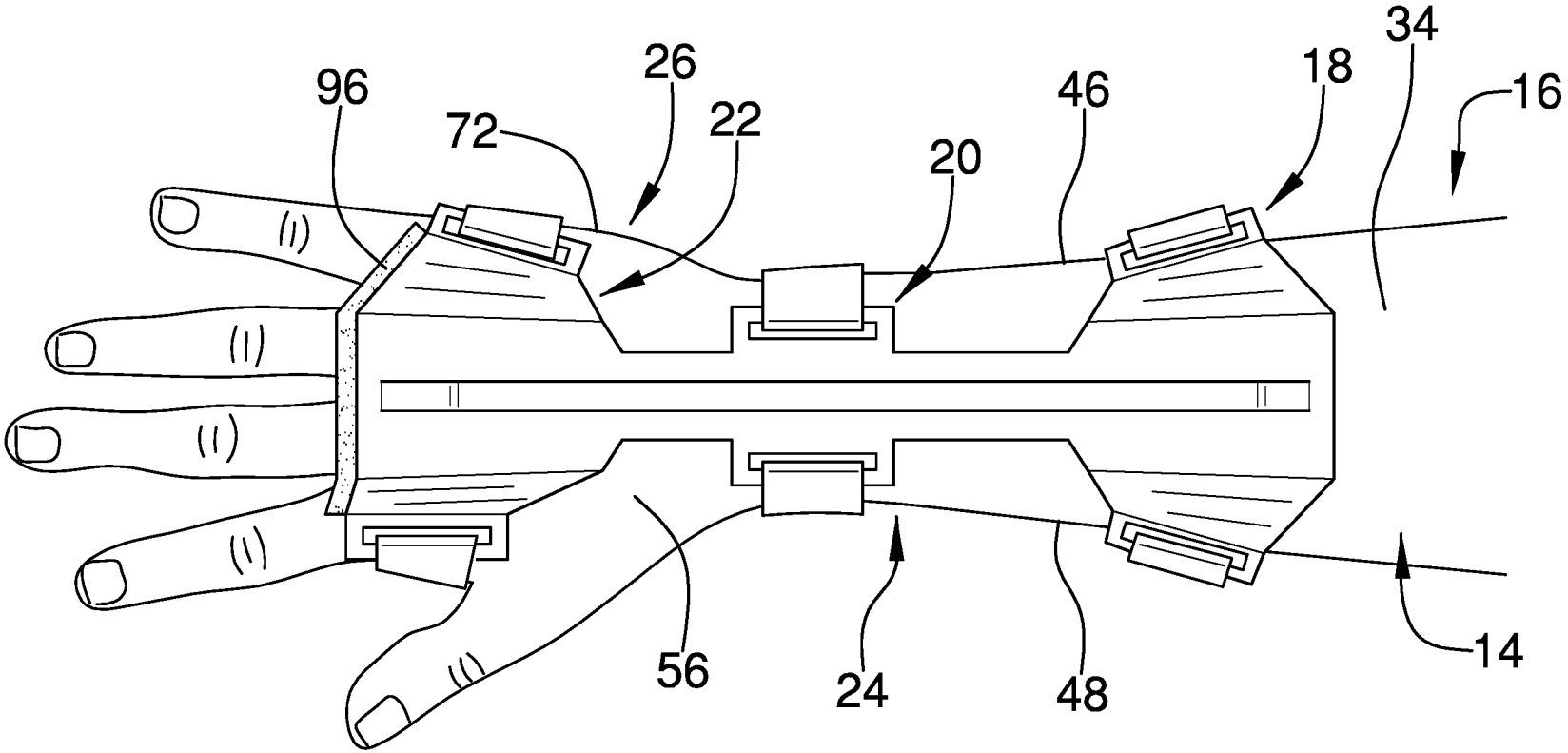
FIG. 5 is a top in-use view of an embodiment of the disclosure.
Figure 6:
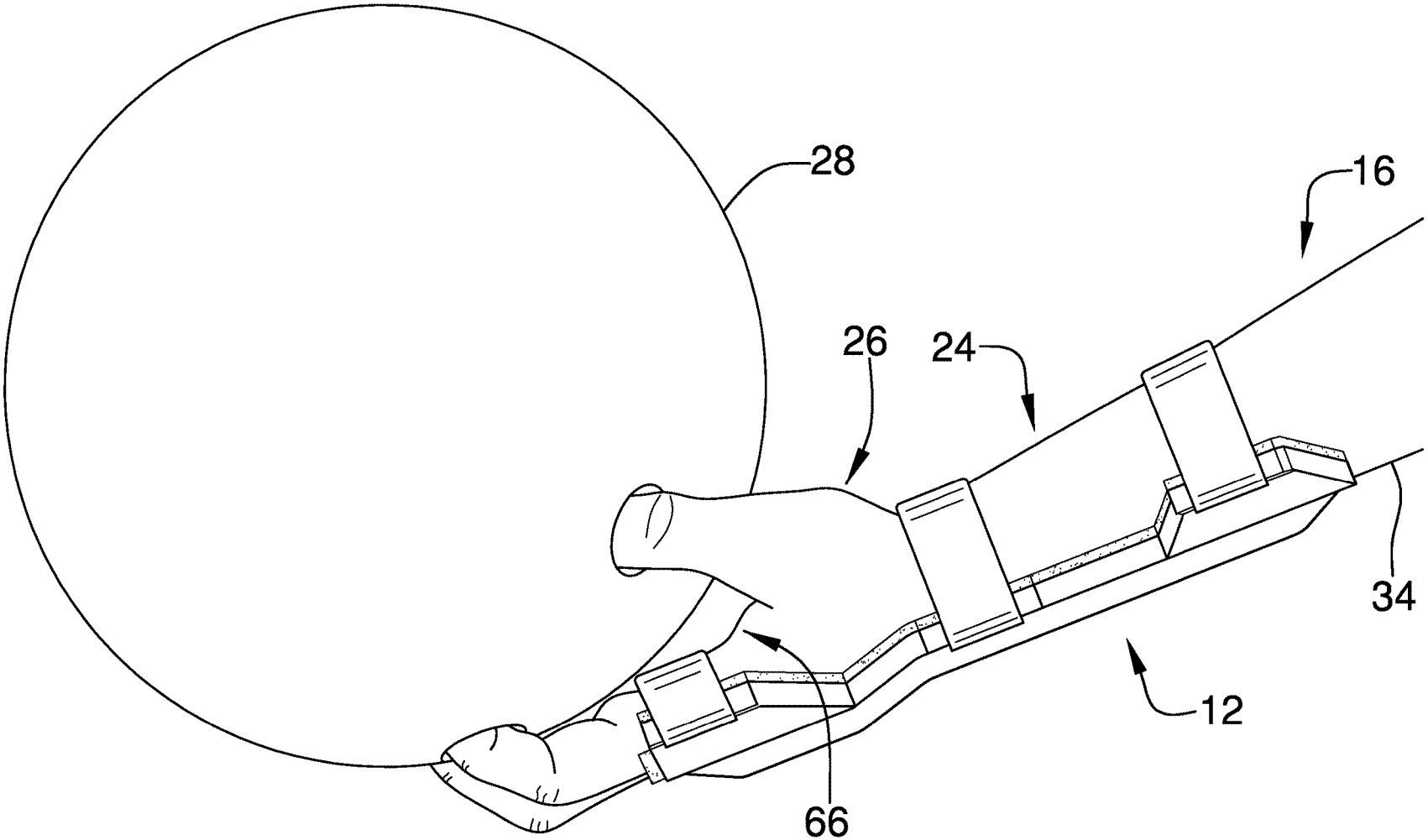
FIG. 6 is a left side in-use view of an embodiment of the disclosure.
Figure 7:
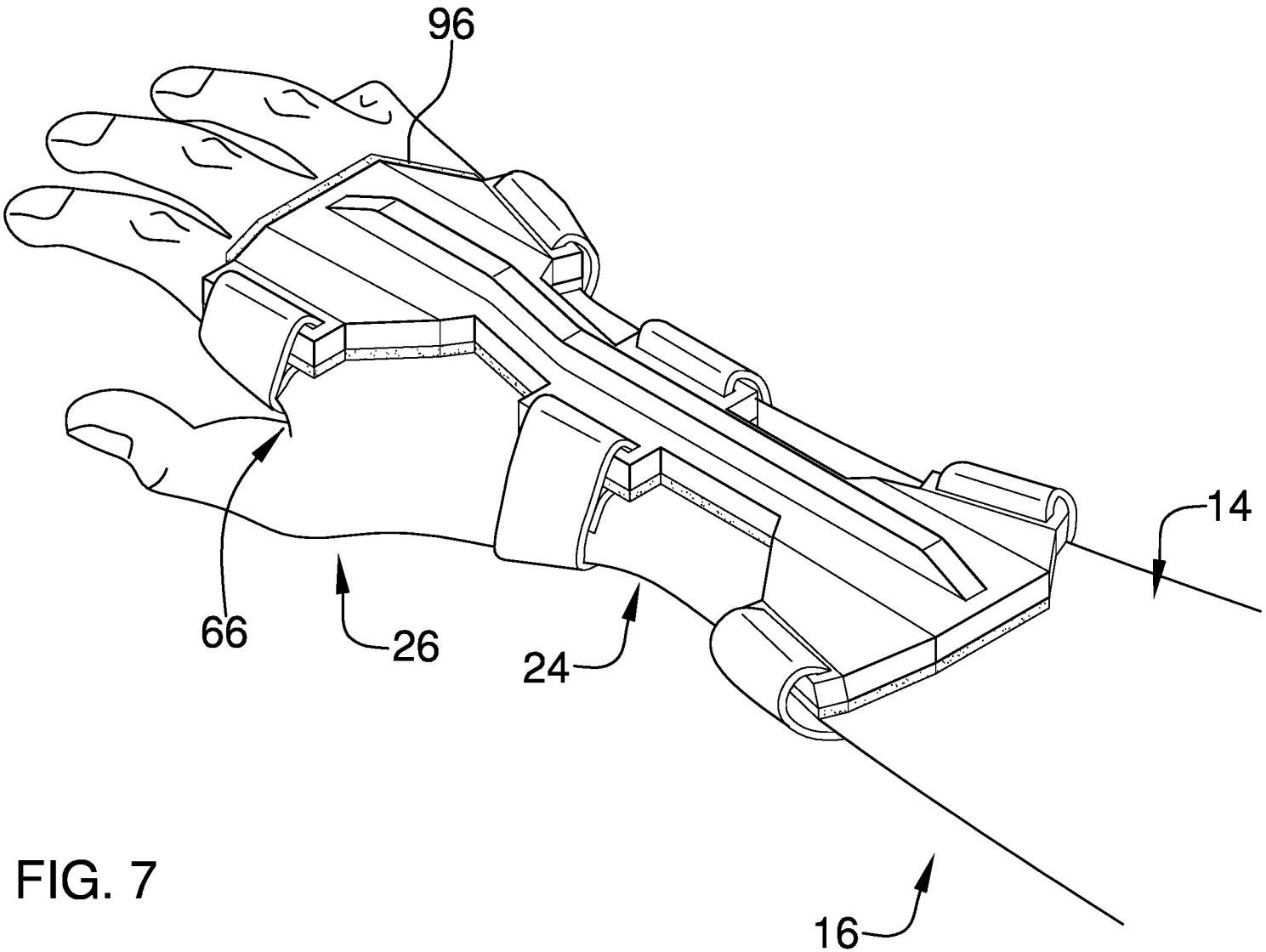
FIG. 7 is a perspective in-use view of an embodiment of the disclosure.

With reference now to the drawings, and in particular to FIGS. 1 through 7 thereof, a new wrist brace device embodying the principles and concepts of an embodiment of the disclosure and generally designated by the reference numeral 10 will be described.

As best illustrated in FIGS. 1 through 7, the bowling wrist brace device 10 generally comprises a brace 12 is elongated along a lengthwise axis 13 of the brace 12 such that the brace 12 extends along a substantial length of a forearm 14 of a bowler 16 when the brace 12 is worn on the bowler's forearm 14. The bowler 16 wears the brace 12 when the bowler 16 is playing one or more rounds of bowling. The brace 12 has a forearm attachment 18, a wrist attachment 20 and a hand attachment 22. The forearm attachment 18 is oriented at a strategic angle with respect to a lengthwise axis 13 of the brace 12 such that the forearm attachment 18 extends laterally beyond the bowler's forearm 14 when the brace 12 is worn on the user's forearm 14. The wrist attachment 20 is oriented parallel to the lengthwise axis 13 such that the wrist attachment 20 is aligned with the bowler's wrist 24 when the brace 12 is worn on the user's forearm 14. The hand attachment 22 is oriented at a strategic angle with respect to the lengthwise axis 13 such that the hand attachment 22 can span the bowler's hand 26 when the brace 12 is worn on the user's forearm 14.

The brace 12 is comprised of a rigid material, including but not being limited to plastic or metal, to inhibit flexion in the bowler's wrist 24 when the bowler 16 releases a bowling ball 28. The forearm attachment 18 has an outer edge 30 which has a series of intersecting sides 32 each oriented at obtuse angles with respect to each other such that the forearm attachment 18 has an irregular polygonal shape. In this way the forearm attachment 18 covers a substantial area of a dorsal side 34 of the bowler's forearm 14. The series of intersecting sides 32 includes a first outward side 36 and a second outward side 38 each being oriented at an angle with respect to the lengthwise axis 13 of the brace 12. In this way each of the first outward side 36 and the second outward side 38 slopes toward a center of the brace 12 between a back end 40 and a front end 42 of the lengthwise axis 13.

The forearm attachment 18 is positioned adjacent to the back end 40 of the lengthwise axis 13. The forearm attachment 18 has a pair of first belt frames 44 each positioned on a respective one of the first outward side 36 and the second outward side 38 such that each of the pair of first belt frames 44 extends laterally beyond a respective one of a lateral side 46 and a medial side 48 of the bowler's forearm 14. Each of the first belt frames 44 defines a belt opening 50 that is elongated to extend along a substantial length of the respective first outward side 36 or the second outward side 38.

The hand attachment 22 has an outside edge 52 which has a series of intersecting sides 54 such that the hand attachment 22 has an irregular polygonal shape. In this way the hand attachment 22 can cover a substantial area of a dorsal side 56 of the bowler's hand 26. The series of intersecting sides 54 of the hand attachment 22 includes a primary outward side 58 extending between a rear outward side 60 and a front outward side 62. The primary outward side 58 is oriented parallel to the lengthwise axis 13 of the brace 12. The rear outward side 60 slopes away from the center of the brace 12 between the back end 40 and the front end 42 of the lengthwise axis 13.

The front outward side 62 angles forwardly from a front side 64 of the series of intersecting sides 54 of the hand attachment 22 such that the primary outward side 58 is aligned with the perlicue 66 of the bowler's hand 26. The series of intersecting sides 54 of the hand attachment 22 includes a secondary outward side 68 that is oriented at an angle with the lengthwise axis 13 of the brace 12 such that the secondary outward side 68 slopes away from the center of the brace 12 between the back end 40 and the front end 42 of the lengthwise axis 13. In this way the secondary outward side 68 is positioned adjacent to an outer side of the bowler's hand 26.

The hand attachment 22 has a pair of second belt frames 70 that is each positioned on a respective one of the primary outward side 58 and the secondary outward side 68 of the series of intersecting sides 54 of the hand attachment 22. In this way each of the second belt frames 70 can extend along a respective one of the perlicue 66 and the outer side 72 of the bowler's hand 26. Each of the second belt frames 70 defines a belt opening 74 that is elongated to extend along a substantial length of the respective primary outward side 58 or the secondary outward side 68. The second belt frame 70 that is positioned on the primary outward side 58 is positioned closer to the front side 64 of the series of intersecting sides 54 of the hand attachment 22 than the second belt frame 70 that is positioned on the secondary outward side 68. Additionally, the hand attachment 22 is positioned adjacent to the front end 42 of the lengthwise axis 13 of the brace 12.

The brace 12 has a stem portion 76 extending between each of the forearm attachment 18 and the hand attachment 22 and the stem portion 76 has an exterior edge 78 which has a first lateral side 80 and a second lateral side 82. The wrist attachment 20 comprises a pair of third belt frames 84 that is each positioned on a respective one of the first lateral side 80 and the second lateral side 82 of the exterior edge 78. Additionally, each of the third belt frames 84 defines a belt opening 86 that is elongated to extend along a substantial length of the respective first lateral side 80 or the second lateral side 82. The pair of third belt frames 84 is aligned with each other and each of the pair of third belt frames 84 is centrally positioned between the forearm attachment 18 and the hand attachment 22.

The stem portion 76 which extends between the wrist attachment 20 and the hand attachment 22 angles upwardly between the wrist attachment 20 and the hand attachment 22. In this way the stem portion 76 which extends between the wrist attachment 20 and the hand attachment 22 can accommodate the bowler's wrist 24 at a preferred angle for releasing the bowling ball 28. The brace 12 has a ridge 88 extending upwardly from a top surface 90 of the brace 12. The ridge 88 is elongated to extend along a substantial length of the lengthwise axis 13 of the brace 12 such that the ridge 88 inhibits flexion of the brace 12 along the lengthwise axis 13. In this way the ridge 88 enhances stability of the bowler's wrist 24 when the bowler 16 releases the bowling ball 28. The ridge 88 has a first end 92 and a second end 94 and each of the first end 92 and the second end 94 of the ridge 88 is sloped.

A cushion 96 is bonded to the brace 12 such that the cushion 96 is positioned between the brace 12 and the bowler's forearm 14 when the brace 12 is worn. The cushion 96 is comprised of a resiliently compressible material, including but not being limited to rubber or silicone, to enhance comfort for the bowler 16. The cushion 96 has an upper surface 98 that is bonded to a bottom surface 100 of the brace 12. Additionally, the cushion 96 has a perimeter edge 102 which has a series of interesting sides 104 that is each strategically oriented to facilitate the cushion 96 to conform to the shape of the brace 12 viewed along an axis extending through the top surface 90 and the bottom surface 100 of the brace 12. Furthermore, the cushion 96 extends forwardly beyond the hand attachment 22 a distance of approximately 6.0 mm to inhibit the hand attachment 22 from being compressed against the bowler's hand 26 for enhancing comfort for the bowler 16. The cushion 96 may have a thickness of approximately 9.0 mm.

A plurality of belts 106 is provided and each of the plurality belts 106 is attached to the brace 12. Each of the plurality of belts 106 can be wrapped around a respective one of the bowler's forearm 14, the bowler's wrist 24 and the bowler's hand 26. Each of the plurality of belts 106 is releasably matable to a respective one of the forearm attachment 18, the wrist attachment 20 and the hand attachment 22 having each of the plurality of belts 106 forming a closed loop. In this way each of the plurality of belts 106 can secure the brace 12 to the bowler's forearm 14.

Each of the plurality of belts 106 has a primary end 108 and a secondary end 110 and a topmost surface 112 extending between the primary end 108 and the secondary end 110. The plurality of belts 106 includes a forearm belt 114, a wrist belt 116 and a hand belt 118. The forearm belt 114 is looped through the belt opening 50 in a respective one of the first belt frames 44 having the primary end 108 of the forearm belt 114 being mated to the forearm belt 114. The wrist belt 116 is looped through the belt opening 86 in a respective one of the third belt frames 84 having the primary end 108 of the wrist belt 116 being mated to the wrist belt 116. The hand belt 118 is looped through the belt opening 74 in a respective one of the second belt frames 70 having the primary end 108 of the hand belt 118 being mated to the hand belt 118.

A plurality of first couplers 120 is provided and each of the plurality of first couplers 120 is attached to the topmost surface 112 of a respective one of the forearm belt 114, the wrist belt 116 or the hand belt 118. Each of the plurality of first couplers 120 is spaced from the secondary end 110 of the respective forearm belt 114 or wrist belt 116 or hand belt 118. A plurality of second couplers 122 is provided and each of the plurality of second couplers 122 is attached to the topmost surface 112 of a respective one of the forearm belt 114 or the wrist belt 116 or the hand belt 118. Each of the plurality of second couplers 122 is positioned adjacent to the secondary end 110 of the respective forearm belt 114 or wrist belt 116 or hand belt 118.

The second coupler 122 on the forearm belt 114 is matable to the first coupler 120 on the forearm belt 114 when the secondary end 110 of the forearm belt 114 is extended through the belt opening 50 in an opposing one of first belt frames 44 with respect to the first belt frame 44 to which the forearm belt 114 is attached for retaining the forearm belt 114 in the closed loop. The second coupler 122 on the wrist belt 116 is matable to the first coupler 120 on the wrist belt 116 when the secondary end 110 of the wrist belt 116 is extended through the belt opening 50 in an opposing one of first belt frames 44 with respect to the first belt frame 44 to which the wrist belt 116 is attached for retaining the wrist belt 116 in the closed loop. Furthermore, the second coupler 122 on the hand belt 118 is matable to the first coupler 120 on the hand belt 118 when the secondary end 110 of the hand belt 118 is extended through the belt opening 50 in an opposing one of first belt frames 44 with respect to the first belt frame 44 to which the hand belt 118 is attached for retaining the hand belt 118 in the closed loop. Each of the first couplers 120 and the second couplers 122 may comprise complementary portions of a hook and loop fastener or other type of multiple use, releasable coupler.

In use, the brace 12 is positioned on the dorsal side 34 of the bowler's forearm 14 such that the brace 12 extends onto the dorsal side 56 of the user's hand 26. Respective ones of the belts 106 are wrapped around the bowler's forearm 14, wrist 24 and hand 26 and is releasably mated to the respective forearm attachment 18 or wrist attachment 20 or hand attachment 22. In this way the brace 12 is retained on the bowler's forearm 14, wrist 24 and hand 26. The brace 12 retains the bowler's wrist 24 at a preferred angle for releasing the bowling ball 28 during the game of bowling. In this way the brace 12 reduces fatigue for the bowler's wrist 24 as well as improving the form and geometry of the bowler's 16 release thereby enhancing the bowler's 16 performance in the game of bowling.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bowling wrist brace device for retaining a bowler's hand and wrist in a preferred orientation for releasing a bowling ball in the game of bowling, said device comprising:

a brace being elongated along a lengthwise axis of said brace wherein said brace is configured to extend along a substantial length of a bowler's forearm when said brace is worn on the bowler's forearm, said brace having a forearm attachment and a wrist attachment and a hand attachment, said forearm attachment being oriented at a strategic angle with respect to a lengthwise axis of said brace wherein said forearm attachment is configured to extend laterally beyond a bowler's forearm when said brace is worn on the user's forearm, said wrist attachment being oriented parallel to said lengthwise axis wherein said wrist attachment is configured to be aligned with the bowler's wrist when said brace is worn on the user's forearm, said hand attachment being oriented at a strategic angle with respect to said lengthwise axis wherein said hand attachment is configured to span the bowler's hand when said brace is worn on the user's forearm, said brace being comprised of a material wherein said brace is configured to inhibit flexion in the bowler's wrist when the bowler releases a bowling ball;

a cushion being bonded to said brace wherein said cushion is configured to be positioned between said brace and the bowler's forearm when said brace is worn, said cushion being comprised of a resiliently compressible material wherein said cushion is configured to enhance comfort for the bowler; and a plurality of belts, each of said plurality belts being attached to said brace wherein each of said plurality of belts is configured to be wrapped around a respective one of the bowler's forearm and the bowler's wrist and the bowler's hand, each of said plurality of belts being releasably matable to a respective one of said forearm attachment and said wrist attachment and said hand attachment having each of said plurality of belts forming a closed loop wherein each of said plurality of belts is configured to secure said brace to the bowler's forearm;

wherein said forearm attachment has an outer edge which has a series of intersecting sides each being oriented at obtuse angles with respect to each other such that said forearm attachment has an irregular polygonal shape wherein said forearm attachment is configured to cover a substantial area of a dorsal side of the bowler's forearm; and wherein said series of intersecting sides includes a first outward side and a second outward side each being oriented at an angle with respect to said lengthwise axis of said brace such that each of said first outward side and said second outward side slopes toward a center of said brace between a back end and a front end of said lengthwise axis; and wherein said forearm attachment is positioned adjacent to said back end of said lengthwise axis.

2. The device according to claim 1, wherein:

said forearm attachment has a pair of first belt frames each being positioned on a respective one of said first outward side and said second outward side wherein each of said pair of first belt frames is configured to extend laterally beyond a respective one of a lateral side and a medial side of the bowler's forearm; and each of said first belt frames defines a belt opening being elongated to extend along a substantial length of said respective first outward side or said second outward side.

3. The device according to claim 2, wherein:

each of said plurality of belts has a primary end and a secondary end and a topmost surface extending between said primary end and said secondary end;

said plurality of belts includes a forearm belt;

said forearm belt being looped through said belt opening in a respective one of said first belt frames having said primary end of said forearm belt being mated to said forearm belt.

4. The device according to claim 1, wherein:

said brace has a stem portion extending between each of said forearm attachment and said hand attachment, said stem portion having an exterior edge which has a first lateral side and a second lateral side;

said wrist attachment comprises a pair of third belt frames each being positioned on a respective one of said first lateral side and said second lateral side of said exterior edge;

each of said third belt frames defines a belt opening being elongated to extend along a substantial length of said respective first lateral side or said second lateral side;

said pair of third belt frames is aligned with each other; and each of said pair of third belt frames is centrally positioned between said forearm attachment and said hand attachment.

5. The device according to claim 4, wherein said stem portion which extends between said wrist attachment and said hand attachment angles upwardly between said wrist attachment and said hand attachment wherein said stem portion extending between said wrist attachment and said hand attachment is configured to accommodate the bowler's wrist at a preferred angle for releasing the bowling ball.

6. The device according to claim 4, wherein:

each of said plurality of belts has a primary end and a secondary end and a topmost surface extending between said primary end and said secondary end;

said plurality of belts includes a wrist belt; and said wrist belt being looped through said belt opening in a respective one of said third belt frames having said primary end of said wrist belt being mated to said wrist belt.

7. The device according to claim 1, wherein:

said brace has a ridge extending upwardly from a top surface of said brace, said ridge being elongated to extend along a substantial length of said lengthwise axis of said brace such that said ridge inhibits flexion of said brace along said lengthwise axis wherein said ridge is configured to enhance stability of the bowler's wrist when the bowler releases the bowling ball; and said ridge has a first end and a second end, each of said first end and said second end of said ridge being sloped.

8. The device according to claim 1, wherein said cushion has an upper surface being bonded to a bottom surface of said brace, said cushion having a perimeter edge which has a series of interesting sides each being strategically oriented to facilitate said cushion to conform to the shape of said brace viewed along an axis extending through a top surface and said bottom surface of said brace.

9. The device according to claim 1, wherein:

each of said plurality of belts has a topmost surface, said plurality of belts includes a forearm belt and a wrist belt and a hand belt;

a plurality of first couplers, each of said plurality of first couplers being attached to said topmost surface of a respective one of said forearm belt or said wrist belt or said hand belt, each of said plurality of first couplers being spaced from said secondary end of said respective forearm belt or wrist belt or hand belt; and a plurality of second couplers, each of said plurality of second couplers being attached to said topmost surface of a respective one of said forearm belt or said wrist belt or said hand belt, each of said plurality of second couplers being positioned adjacent to said secondary end of said respective forearm belt or wrist belt or hand belt.

10. The device according to claim 9, wherein said second coupler on said forearm belt is matable to said first coupler on said forearm belt when said secondary end of said forearm belt is extended through said belt opening in an opposing one of first belt frames with respect to said first belt frame to which said forearm belt is attached for retaining said forearm belt in said closed loop.

11. The device according to claim 9, wherein said second coupler on said wrist belt is matable to said first coupler on said wrist belt when said secondary end of said wrist belt is extended through said belt opening in an opposing one of first belt frames with respect to said first belt frame to which said wrist belt is attached for retaining said wrist belt in said closed loop.

12. The device according to claim 9, wherein said second coupler on said hand belt is matable to said first coupler on said hand belt when said secondary end of said hand belt is extended through said belt opening in an opposing one of first belt frames with respect to said first belt frame to which said hand belt is attached for retaining said hand belt in said closed loop.

13. A bowling wrist brace device for retaining a bowler's hand and wrist in a preferred orientation for releasing a bowling ball in the game of bowling, said device comprising:

a brace being elongated along a lengthwise axis of said brace wherein said brace is configured to extend along a substantial length of a bowler's forearm when said brace is worn on the bowler's forearm, said brace having a forearm attachment and a wrist attachment and a hand attachment, said forearm attachment being oriented at a strategic angle with respect to a lengthwise axis of said brace wherein said forearm attachment is configured to extend laterally beyond a bowler's forearm when said brace is worn on the user's forearm, said wrist attachment being oriented parallel to said lengthwise axis wherein said wrist attachment is configured to be aligned with the bowler's wrist when said brace is worn on the user's forearm, said hand attachment being oriented at a strategic angle with respect to said lengthwise axis wherein said hand attachment is configured to span the bowler's hand when said brace is worn on the user's forearm, said brace being comprised of a material wherein said brace is configured to inhibit flexion in the bowler's wrist when the bowler releases a bowling ball;

a cushion being bonded to said brace wherein said cushion is configured to be positioned between said brace and the bowler's forearm when said brace is worn, said cushion being comprised of a resiliently compressible material wherein said cushion is configured to enhance comfort for the bowler;

a plurality of belts, each of said plurality belts being attached to said brace wherein each of said plurality of belts is configured to be wrapped around a respective one of the bowler's forearm and the bowler's wrist and the bowler's hand, each of said plurality of belts being releasably matable to a respective one of said forearm attachment and said wrist attachment and said hand attachment having each of said plurality of belts forming a closed loop wherein each of said plurality of belts is configured to secure said brace to the bowler's forearm;

wherein said hand attachment has an outside edge which has a series of intersecting sides such that said hand attachment has an irregular polygonal shape wherein said handle attachment is configured to cover a substantial area of a dorsal side of the bowler's hand;

wherein said series of intersecting sides of said hand attachment includes a primary outward side extending between a rear outward side and a front outward side;

wherein said primary outward side being oriented parallel to said lengthwise axis of said brace;

wherein said rear outward side slopes away from said center of said brace between said back end and said front end of said lengthwise axis;

wherein said front outward side angles forwardly from a front side of said series of intersecting sides of said hand attachment wherein said primary outward side is configured to be aligned with the perlicue of the bowler's hand;

wherein said series of intersecting sides of said hand attachment includes a secondary outward side being oriented at an angle with said lengthwise axis of said brace such that said secondary outward side slopes away from said center of said brace between said back end and said front end of said lengthwise axis wherein said secondary outward side is configured to be positioned adjacent to an outer side of the bowler's hand; and wherein said hand attachment is positioned adjacent to said front end of said lengthwise axis of said brace.

14. The device according to claim 13, wherein;

said hand attachment has a pair of second frames each being positioned on a respective one of said primary outward side and said secondary outward side of said series of intersecting sides of said hand attachment wherein each of said second frames is configured to extend along a respective one of the perlicue and the outer side of the bowler's hand;

each of said second belt frames defines a belt opening being elongated to extend along a substantial length of said respective primary outward side or said secondary outward side; and said second belt frame that is positioned on said primary outward side is positioned closer to said front side of said series of intersecting sides of said hand attachment than said second belt frame that is positioned on said secondary outward side.

15. The device according to claim 14, wherein:

each of said plurality of belts has a primary end and a secondary end and a topmost surface extending between said primary end and said secondary end;

said plurality of belts includes a hand belt; and said hand belt is looped through said belt opening in a respective one of said second belt frames having said primary end of said wrist belt being mated to said wrist belt.

16. A bowling wrist brace device for retaining a bowler's hand and wrist in a preferred orientation for releasing a bowling ball in the game of bowling, said device comprising:

a brace being elongated along a lengthwise axis of said brace wherein said brace is configured to extend along a substantial length of a bowler's forearm when said brace is worn on the bowler's forearm, said brace having a forearm attachment and a wrist attachment and a hand attachment, said forearm attachment being oriented at a strategic angle with respect to a lengthwise axis of said brace wherein said forearm attachment is configured to extend laterally beyond a bowler's forearm when said brace is worn on the user's forearm, said wrist attachment being oriented parallel to said lengthwise axis wherein said wrist attachment is configured to be aligned with the bowler's wrist when said brace is worn on the user's forearm, said hand attachment being oriented at a strategic angle with respect to said lengthwise axis wherein said hand attachment is configured to span the bowler's hand when said brace is worn on the user's forearm, said brace being comprised of a material wherein said brace is configured to inhibit flexion in the bowler's wrist when the bowler releases a bowling ball, said forearm attachment having an outer edge which has a series of intersecting sides each being oriented at obtuse angles with respect to each other such that said forearm attachment has an irregular polygonal shape wherein said forearm attachment is configured to cover a substantial area of a dorsal side of the bowler's forearm, said series of intersecting sides including a first outward side and a second outward side each being oriented at an angle with respect to said lengthwise axis of said brace such that each of said first outward side and said second outward side slopes toward a center of said brace between a back end and a front end of said lengthwise axis, said forearm attachment being positioned adjacent to said back end of said lengthwise axis, said forearm attachment having a pair of first belt frames each being positioned on a respective one of said first outward side and said second outward side wherein each of said pair of first belt frames is configured to extend laterally beyond a respective one of a lateral side and a medial side of the bowler's forearm, each of said first belt frames defining a belt opening being elongated to extend along a substantial length of said respective first outward side or said second outward side, said hand attachment having an outside edge which has a series of intersecting sides such that said hand attachment has an irregular polygonal shape wherein said handle attachment is configured to cover a substantial area of a dorsal side of the bowler's hand, said series of intersecting sides of said hand attachment including primary outward side extending between a rear outward side and a front outward side, said primary outward side being oriented parallel to said lengthwise axis of said brace, said rear outward side sloping away from said center of said brace between said back end and said front end of said lengthwise axis, said front outward side angling forwardly from a front side of said series of intersecting sides of said hand attachment wherein said primary outward side is configured to be aligned with the perlicue of the bowler's hand, said series of intersecting sides of said hand attachment including a secondary outward side being oriented at an angle with said lengthwise axis of said brace such that said secondary outward side slopes away from said center of said brace between said back end and said front end of said lengthwise axis wherein said secondary outward side is configured to be positioned adjacent to an outer side of the bowler's hand, said hand attachment having a pair of second frames each being positioned on a respective one of said primary outward side and said secondary outward side of said series of intersecting sides of said hand attachment wherein each of said second frames is configured to extend along a respective one of the perlicue and the outer side of the bowler's hand, each of said second belt frames defining a belt opening being elongated to extend along a substantial length of said respective primary outward side or said secondary outward side, said second belt frame that is positioned on said primary outward side being positioned closer to said front side of said series of intersecting sides of said hand attachment than said second belt frame that is positioned on said secondary outward side, said hand attachment being positioned adjacent to said front end of said lengthwise axis of said brace, said brace having a stem portion extending between each of said forearm attachment and said hand attachment, said stem portion having an exterior edge which has a first lateral side and a second lateral side, said wrist attachment comprising a pair of third belt frames each being positioned on a respective one of said first lateral side and said second lateral side of said exterior edge, each of said third belt frames defining a belt opening being elongated to extend along a substantial length of said respective first lateral side or said second lateral side, said pair of third belt frames being aligned with each other, each of said pair of third belt frames being centrally positioned between said forearm attachment and said hand attachment, said stem portion which extends between said wrist attachment and said hand attachment angling upwardly between said wrist attachment and said hand attachment wherein said stem portion extending between said wrist attachment and said hand attachment is configured to accommodate the bowler's wrist at a preferred angle for releasing the bowling ball, said brace having a ridge extending upwardly from a top surface of said brace, said ridge being elongated to extend along a substantial length of said lengthwise axis of said brace such that said ridge inhibits flexion of said brace along said lengthwise axis wherein said ridge is configured to enhance stability of the bowler's wrist when the bowler releases the bowling ball, said ridge having a first end and a second end, each of said first end and said second end of said ridge being sloped;

a cushion being bonded to said brace wherein said cushion is configured to be positioned between said brace and the bowler's forearm when said brace is worn, said cushion being comprised of a resiliently compressible material wherein said cushion is configured to enhance comfort for the bowler, said cushion having an upper surface being bonded to a bottom surface of said brace, said cushion having a perimeter edge which has a series of interesting sides each being strategically oriented to facilitate said cushion to conform to the shape of said brace viewed along an axis extending through said top surface and said bottom surface of said brace;

a plurality of belts, each of said plurality belts being attached to said brace wherein each of said plurality of belts is configured to be wrapped around a respective one of the bowler's forearm and the bowler's wrist and the bowler's hand, each of said plurality of belts being releasably matable to a respective one of said forearm attachment and said wrist attachment and said hand attachment having each of said plurality of belts forming a closed loop wherein each of said plurality of belts is configured to secure said brace to the bowler's forearm, each of said plurality of belts having a primary end and a secondary end and a topmost surface extending between said primary end and said secondary end, said plurality of belts including a forearm belt and a wrist bend and a hand belt, said forearm belt being looped through said belt opening in a respective one of said first belt frames having said primary end of said forearm belt being mated to said forearm belt, said wrist belt being looped through said belt opening in a respective one of said third belt frames having said primary end of said wrist belt being mated to said wrist belt, said hand belt being looped through said belt opening in a respective one of said second belt frames having said primary end of said hand belt being mated to said hand belt;

a plurality of first couplers, each of said plurality of first couplers being attached to said topmost surface of a respective one of said forearm belt or said wrist belt or said hand belt, each of said plurality of first couplers being spaced from said secondary end of said respective forearm belt or wrist belt or hand belt; and a plurality of second couplers, each of said plurality of second couplers being attached to said topmost surface of a respective one of said forearm belt or said wrist belt or said hand belt, each of said plurality of second couplers being positioned adjacent to said secondary end of said respective forearm belt or wrist belt or hand belt, said second coupler on said forearm belt being matable to said first coupler on said forearm belt when said secondary end of said forearm belt is extended through said belt opening in an opposing one of first belt frames with respect to said first belt frame to which said forearm belt is attached for retaining said forearm belt in said closed loop, said second coupler on said wrist belt being matable to said first coupler on said wrist belt when said secondary end of said wrist belt is extended through said belt opening in an opposing one of first belt frames with respect to said first belt frame to which said wrist belt is attached for retaining said wrist belt in said closed loop, said second coupler on said hand belt being matable to said first coupler on said hand belt when said secondary end of said hand belt is extended through said belt opening in an opposing one of first belt frames with respect to said first belt frame to which said hand belt is attached for retaining said hand belt in said closed loop.

* * * * *